US006701953B2

(12) United States Patent
Agosta

(10) Patent No.: US 6,701,953 B2
(45) Date of Patent: Mar. 9, 2004

(54) CHEMICAL MIXING AND METERING APPARATUS

(75) Inventor: Vito Agosta, Huntington, NY (US)

(73) Assignee: Stay Green, Inc., Moriches, NY (US)

( * ) Notice: Subject to any disclaimer, the term of this patent is extended or adjusted under 35 U.S.C. 154(b) by 0 days.

(21) Appl. No.: 10/166,481

(22) Filed: Jun. 11, 2002

(65) Prior Publication Data

US 2003/0226589 A1 Dec. 11, 2003

(51) Int. Cl.[7] ..... E03B 7/07

(52) U.S. Cl. ..... 137/268; 137/205.5; 137/564.5; 422/264; 422/282

(58) Field of Search ..... 137/268, 205.5, 137/564.5; 422/264, 276, 282

(56) References Cited

U.S. PATENT DOCUMENTS 1,085,348 A * 1/1914 Ledoux ..... 137/268
3,807,434 A * 4/1974 Rasmussen et al. ..... 137/268
4,694,900 A * 9/1987 Behrens ..... 137/268 X
4,908,190 A * 3/1990 Maglio et al. ..... 137/268 X
5,580,448 A * 12/1996 Brandreth, III ..... 137/268 X
6,453,935 B1 * 9/2002 Gilmore ..... 137/268

* cited by examiner

*Primary Examiner*—Kevin Lee
(74) *Attorney, Agent, or Firm*—Carter, Deluca, Farrell & Schmidt, LLP

(57) ABSTRACT

A chemical mixing and metering apparatus is provided which can be easily incorporated into existing irrigation lines. The apparatus includes a venturi which is positioned along an irrigation supply line. The venturi is connected to a chemical supply container by a chemical conduit and by a bypass conduit. A valve is positioned in the bypass conduit to regulate the flow of irrigation fluid from the irrigation supply line into the chemical supply container. A check valve or vent is provided in the container to prevent formation of a vacuum. The chemical mixing and metering apparatus is operable in two modes of operation. Firstly, the apparatus may be operated as a vacuum system by closing the valve in the bypass conduit. Secondly, the system may be operated in a force feed/vacuum mode by opening the valve in the bypass conduit. Moreover, the apparatus may be used to inject solid and/or liquid chemicals into an irrigation system.

13 Claims, 4 Drawing Sheets

CHEMICAL MIXING AND METERING APPARATUS

BACKGROUND

1. Technical Field

The present disclosure relates generally to an apparatus for mixing two components together. More particularly, the present disclosure relates to a fertilizer mixing and metering apparatus for adding a chemical fertilizer into a water supply line of an irrigation system.

2. Background to Related Art

A variety of different types of systems for mixing chemicals, including fertilizers, pesticides, herbicides, lime, etc., into irrigation supply lines are known. These systems include apparatus for adding liquid and solid chemicals into an irrigation supply line. Typically, liquid injection systems include a pump for injecting a chemical into the irrigation supply line, and solid chemical systems include a solid chemical container through which at least a portion of the irrigation fluid is directed. These systems are generally limited as to the type of chemical, i.e., liquid or solid, that they are able to mix with irrigation fluid. Moreover, such systems can be overly complex and not easily incorporated into existing irrigation systems.

Accordingly, a need exists for an improved chemical mixing apparatus which can be easily incorporated into existing irrigation systems and can be used with both liquid and solid chemicals.

SUMMARY

In accordance with the present invention, a chemical mixing and metering apparatus is provided which can be easily incorporated into existing irrigation lines. The apparatus includes a venturi which is positioned along an irrigation supply line. The venturi is connected to a chemical supply container by a chemical conduit and by a bypass conduit. A valve is positioned in the bypass conduit to regulate the flow of irrigation fluid from the irrigation supply line into the chemical supply container. A check valve or vent is provided in the container to prevent formation of a vacuum.

The presently disclosed chemical mixing and metering apparatus is operable in two modes of operation. Firstly, the apparatus may be operated as a vacuum system by closing the valve in the bypass conduit. Secondly, the system may be operated in a force feed/vacuum mode by opening the valve in the bypass conduit. Moreover, the apparatus may be used to inject solid and/or liquid chemicals into an irrigation system.

BRIEF DESCRIPTION OF THE DRAWINGS

Preferred embodiment of the presently disclosed chemical mixing and metering apparatus are described herein with reference to the drawings, wherein.

DETAILED DESCRIPTION OF PREFERRED EMBODIMENTS

Figure 1:
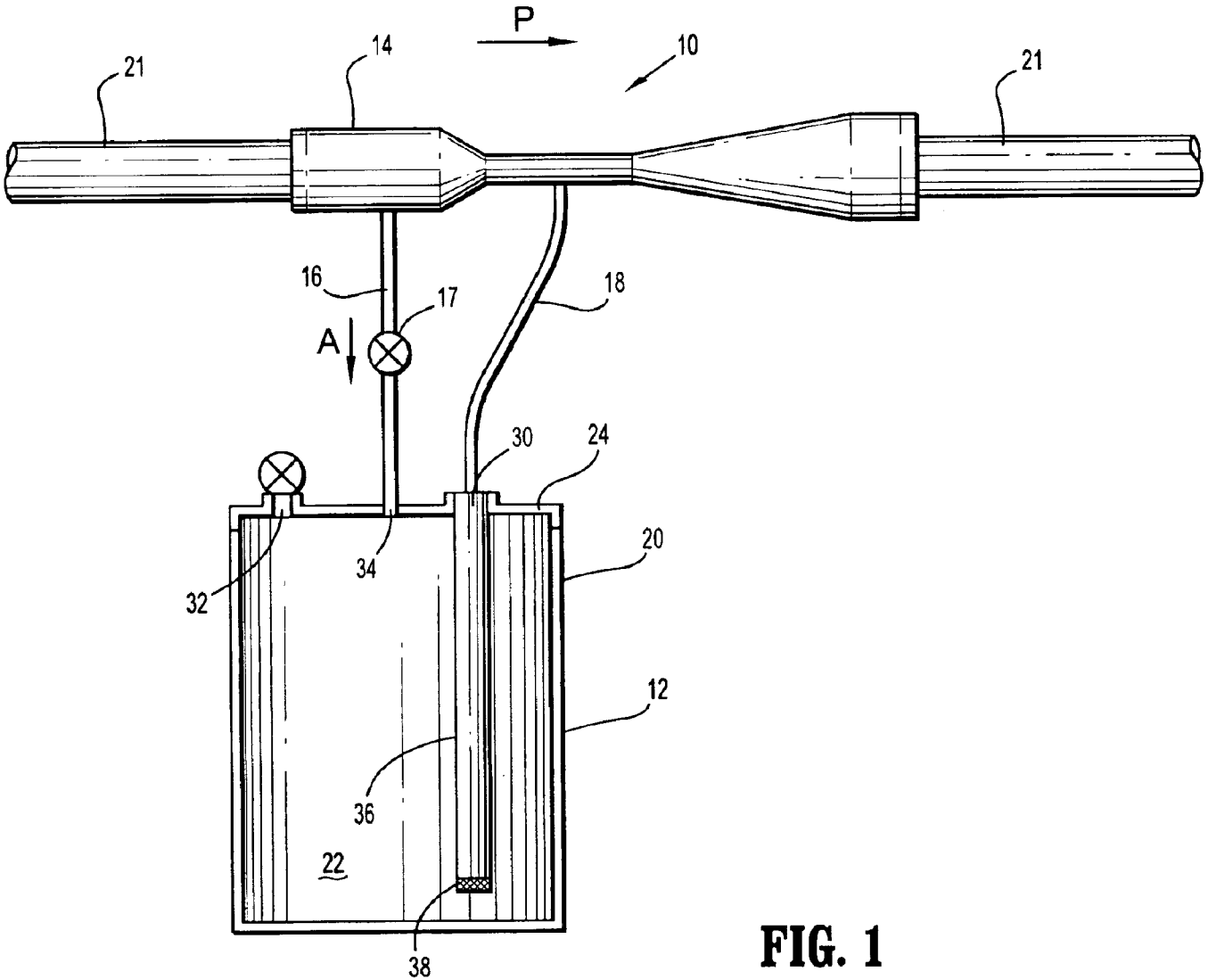
FIG. 1 is a side elevational partial cross-sectional view of the presently disclosed chemical mixing and metering apparatus.

Preferred embodiments of the presently disclosed chemical mixing and metering apparatus will now be described in detail with reference to the figures in which like reference numerals designate identical or corresponding elements in each of the several views.

Referring to FIG. 1, the presently disclosed chemical mixing and metering apparatus, shown generally as 10, includes a chemical supply container 12, a venturi 14, a bypass conduit 16, a chemical conduit 18, and an irrigation fluid conduit 21. Chemical supply container 12 includes body 20 defining a reservoir 22. A cover 24 is removably secured to body 20 by screw threads (not shown). Alternately, cover 24 can be removably secured to body 20 using other known fastening techniques including screws, elastic bands, friction, etc. Cover 20 includes three openings 30, 32 and 34. Opening 30 is dimensioned to receive and support the upper end of standpipe 36. Standpipe 36 extends from a top portion of reservoir 22 towards the base of reservoir 22 and includes a bottom end having a filter or screen 38 secured thereto. An adaptor (not shown) is secured about opening 30 and is configured to releasably engage one end of chemical conduit 18. Opening 32 includes a closeable vent such as a stopcock or the like. Alternately, vent opening 32 may include a check valve such as a spring-based ball check valve which allows flow into the container but not out of the container. Opening 34 includes an adaptor configured to engage one end of bypass conduit 16. Bypass conduit 16 includes a valve 17 which can be opened to allow irrigation water to flow therethrough or closed to prevent irrigation water from flowing therethrough.

Figure 2:
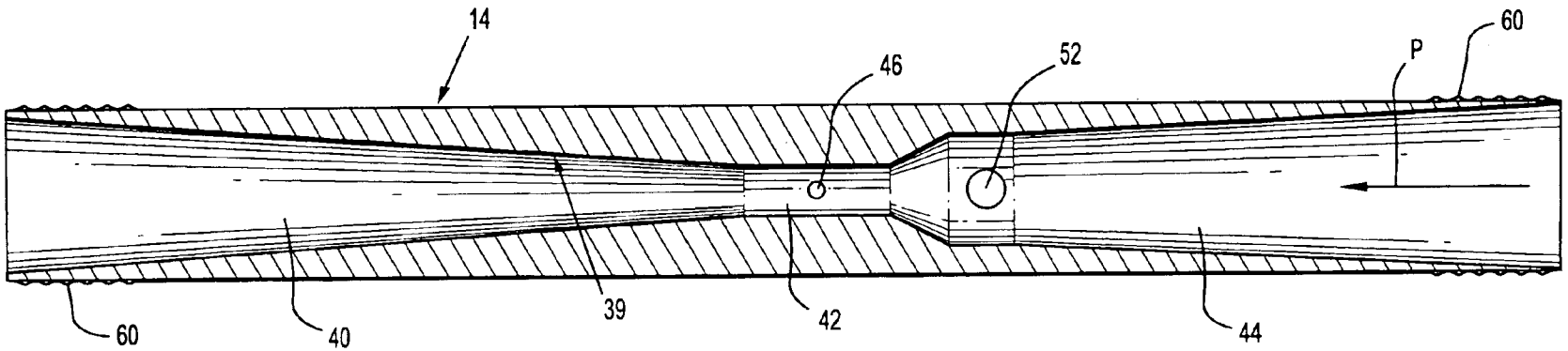
FIG. 2 is a cross-sectional view of the venturi of the presently disclosed mixing and metering apparatus shown in FIG. 1.
Figure 3:
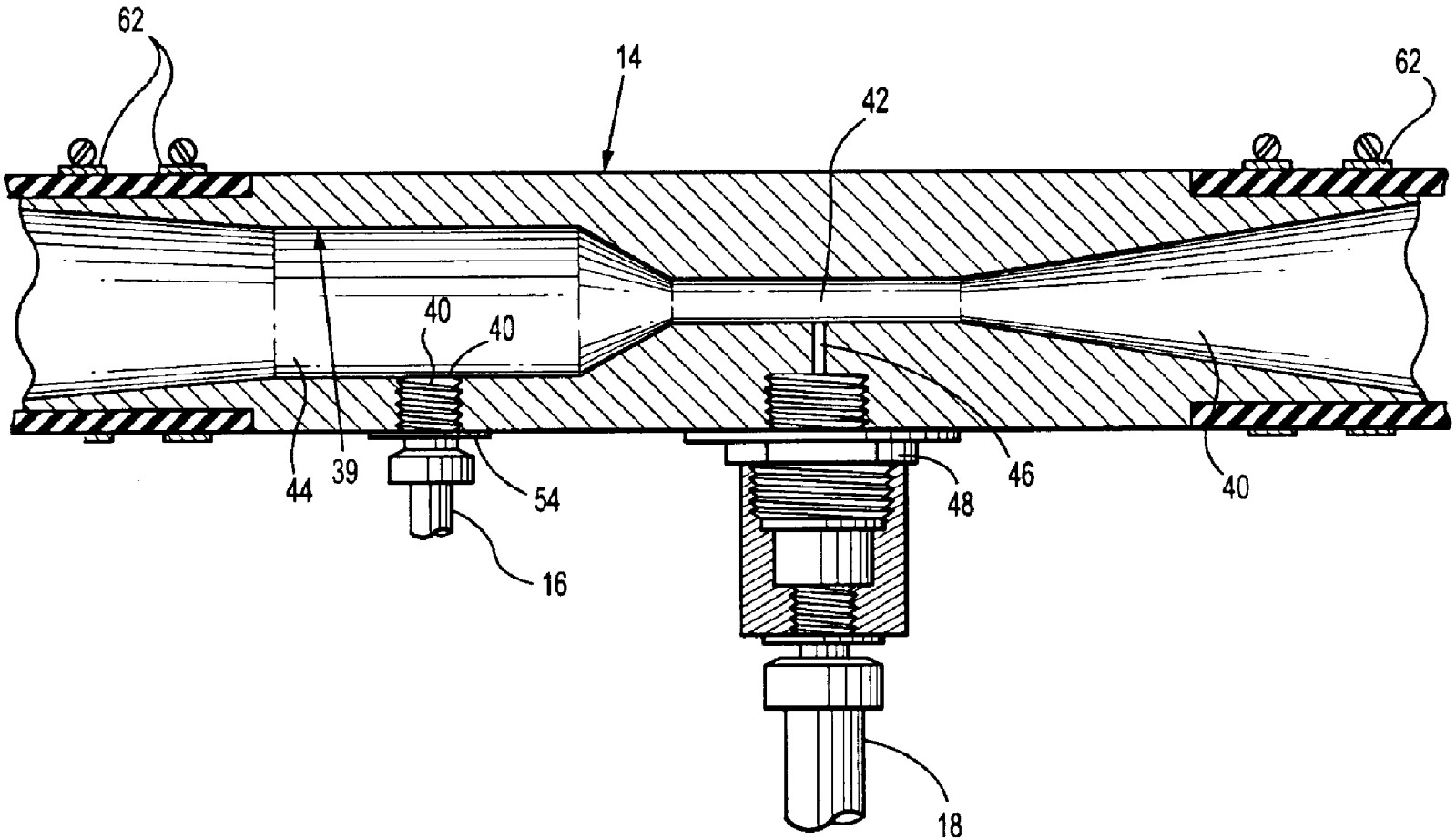
FIG. 3 is a cross-sectional, partial cutaway view of the venturi of the presently disclosed chemical mixing and metering apparatus incorporated into an existing irrigation line with adaptors attached thereto.

Referring to FIGS. 2 and 3, venturi 14 includes a converging and diverging conduit 39 including a converging section 44, a central portion 42 and a diverging portion 40. Venturi 14 includes a first bore 46 which opens into central portion 42 of converging and diverging conduit 39. Bore 46 communicates with an adapter 48 having a bore 50 that communicates with chemical conduit 18. Venturi 14 also includes a second bore 52 which opens into converging section 44. Bore 52 is in fluid communication with an adapter 54 having a bore 56 in fluid communication with bypass conduit 16.

Venturi 14 is adapted to be positioned or fitted in an irrigation supply line of an existing irrigation system. This can be accomplished by cutting a section of pipe from an irrigation supply line and securing venturi 14 in its place. Each end of venturi 14 may include screw threads 60 (FIG. 2) to facilitate securement to the irrigation line. Alternately, clamps 62 (FIG. 3) or other known fastening techniques may be used to secure venturi 14 in position in the irrigation supply line.

Chemical mixing and metering apparatus 10 may be operated in two different modes of operation. In each mode of operation, irrigation water is supplied from irrigation line 21 through venturi 14 in the direction indicated by arrow "P". In a first mode of operation, valve 17 in bypass conduit 16 is opened to allow irrigation water to flow from venturi section 44, in the direction indicated by arrow "A", through opening 52, into bypass conduit 16, and into chemical supply container 12. As the fluid flows through venturi 14 from convergent section 44 to divergent section 40, through central portion 42, the tapering constriction of the central portion of conduit 39 causes the velocity of the fluid flow to increase with a corresponding decrease in pressure in the area adjacent bore 46. The combination of the decrease in pressure adjacent to bore 46 in conduit 39 and the increased pressure in supply container 12 caused by fluid flow from bypass conduit 16 causes chemicals in container 12 to flow upwardly through standpipe 36, chemical conduit 18 and bore 46 into the central portion 42 of conduit 39 to mix with the irrigation fluid within irrigation line 21.

In the first mode of operation, both liquid and solid chemicals can be distributed by mixing and metering apparatus 10. Since, the chemical in container 12 is constantly being diluted as fluid enters container 12 through bypass line 16, the concentration of the chemical in the fluid being distributed by the irrigation system in the first mode of operation will change with time.

In a second mode of operation, valve 17 in bypass line 16 is closed and vent 32 is opened Alternately, if a check valve with a preset opening pressure has been incorporated into system 10, vent 32 need not be manually opened. As fluid flows through irrigation supply line 21 and venturi 14, in the direction indicated by arrow "P", chemical in container 12 is drawn from container 12 through chemical conduit 18 and bore 46 in venturi 14 and is mixed with the irrigation fluid. As discussed above, this occurs as a result of the decrease in fluid pressure adjacent bore 46 in venturi 14. The flow rate of chemical through conduit 18 will change in response to changes in the irrigation fluid flow rate through venturi 14. However, the concentration of the chemical in the irrigation fluid will be consistent over time if the irrigation fluid supply is maintained constant.

The components of chemical mixing and metering apparatus 10 can be formed of any material or materials meeting the requisite strength requirements including plastics and metals. Preferably, the components are formed of plastic such as polyvinyl chloride or Lucite®. It is also envisioned that venturi 14, conduit 16 and conduit 18 can be formed, e.g., molded, of monolithic construction. Cover 24 can also be formed monolithically therewith. Alternately, each of the components may be individually constructed and secured to the other components using known fastening techniques including threads, welds, etc.

Figure 4:
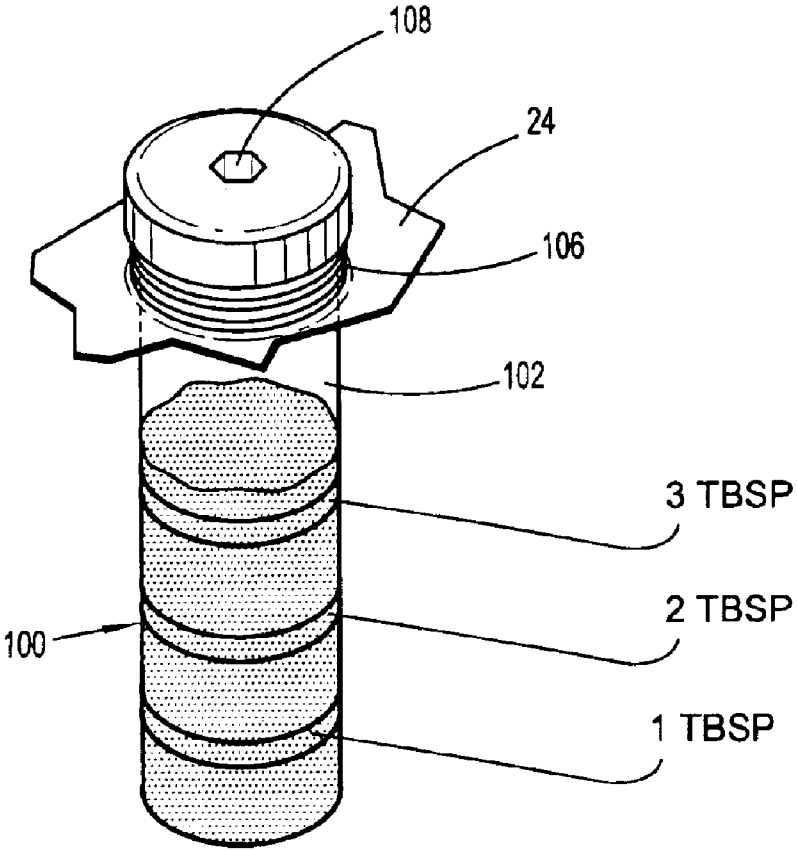
FIG. 4 is a top perspective, partial cutaway view of a removable reservoir or chemical holder assembly for use with the presently disclosed chemical mixing and metering apparatus shown in FIG. 1.

Referring to FIG. 4, chemicals may be added to container 12 using a removable reservoir or chemical holder assembly 100 which is preferably supported on cover 24. Removable reservoir assembly 100 includes a cylindrical reservoir 102 and a cap 104. Alternately, it is envisioned that reservoir 102 may have other configurations, e.g., rectangular, oval, square, etc. Reservoir 102 has an open top end. Cap 104 is removably secured to the open top end of reservoir 102 in a known manner, e.g., screw threads, friction fit, etc., to seal the reservoir. The outer surface of reservoir 102 or, alternately, cap 104 includes threads 106 for securing reservoir assembly 100 to cover 24. Cap 104 preferably includes engagement structure 108, e.g., allan wrench bore, phillips head bore, slotted bore, etc., formed therein to facilitate attachment of cap 104 to reservoir 102 and/or attachment of reservoir assembly 100 to cover 24.

Reservoir 102 may be formed form a permeable material which allows a liquid chemical to diffuse therethrough at a controlled rate when it is placed within supply container 12. Alternately, reservoir 102 may include one or more holes which allow chemical to escape from reservoir 102 into irrigation fluid located within supply container 112. Preferably, reservoir 102 includes gradations indicating the amount of chemical located within reservoir 102. Although illustrated as identifying the number of tablespoons of chemical in reservoir 102, other units of measure may be used, e.g., ounces etc.

Figure 5:
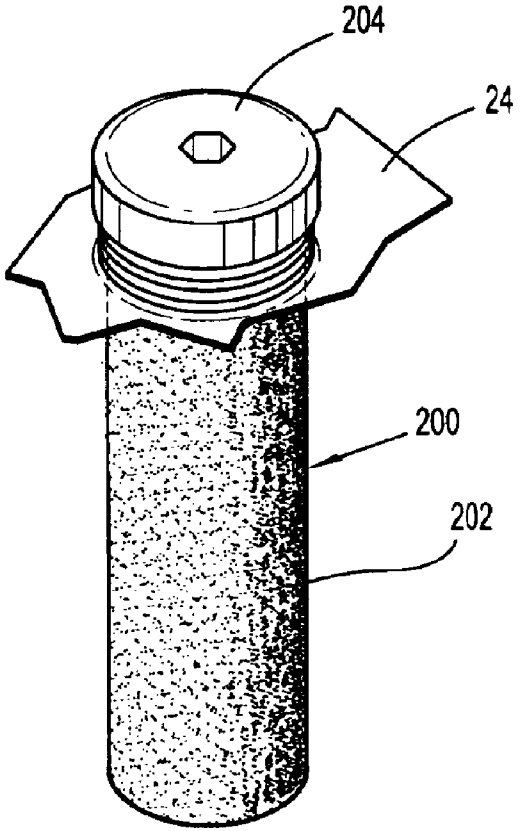
FIG. 5 is a top perspective, partial cutaway view of an alternate embodiment of the removable reservoir or chemical holder assembly shown in FIG. 4.

FIG. 5 illustrates another preferred embodiment of the removable reservoir or chemical holder assembly, shown generally as 200. In assembly 200, reservoir 102 has been replaced by a solid chemical 202, solid chemical 202 is secured to a cap 204 which is adapted to be secured to cover 24 of container 12 in a manner similar to that disclosed above with respect to reservoir assembly 100.

It will be understood that various modifications may be made to the embodiments disclosed herein. For example, although the apparatus was described for use with fertilizer systems, it is envisioned that apparatus may be suitable for other uses, e.g., mixing soap or detergents with water. Therefore, the above description should not be construed as limiting, but merely as exemplifications of preferred embodiments. Those skilled in the art will envision other modifications within the scope and spirit of the claims appended hereto.

What is claimed is:

1. A chemical mixing and metering apparatus comprising:

a chemical supply container for housing a chemical, the chemical supply container defining an opening and including a cover for sealing the opening;

a removable chemical holder supported by the cover and extending into the chemical supply container;

a venturi including a conduit having an inlet portion, a central portion and an outlet portion, the inlet portion of the conduit defining a convergent section and the outlet portion defining divergent section, the venturi being adapted to be positioned along an irrigation supply line;

a chemical conduit interconnecting the central portion of the venturi conduit and the chemical supply container; and a bypass conduit interconnecting the inlet portion of the venturi conduit and the chemical supply container.

2. A chemical mixing and metering apparatus according to claim 1, further including a valve positioned in the bypass conduit.

3. A chemical mixing and metering apparatus according to claim 1, wherein the chemical supply container has an opening at its upper end and includes a top cover for sealing the opening, the chemical conduit and the bypass conduit communicating with openings formed in the top cover of the chemical supply container.

4. A chemical mixing and metering apparatus according to claim 2, wherein the venturi, the chemical conduit, the bypass conduit and the top cover are formed of monolithic construction.

5. A chemical mixing and metering apparatus according to claim 1, wherein the venturi, the chemical conduit and bypass conduit are formed of monolithic construction.

6. A chemical mixing and metering apparatus according to claim 1, further including a standpipe defining a fluid passage, the standpipe being positioned within the chemical supply container and extending from an upper portion of the chemical supply container to a bottom portion of the chemical supply container, the fluid passage of the standpipe communicating with the chemical conduit.

7. A chemical mixing and metering apparatus according to claim 6, wherein the standpipe includes a filter at one end thereof.

8. A chemical mixing and metering apparatus according to claim 1, wherein the chemical supply container includes an opening and a cover for sealing the opening.

9. A chemical mixing and metering apparatus according to claim 1, wherein the removable chemical holder includes a cap portion and a reservoir portion, the reservoir portion defining an opening and the cap portion being removably secured within the opening of the reservoir portion.

10. A chemical mixing and metering apparatus according to claim 9, wherein the reservoir portion is formed of a permeable material which allows liquid chemical to diffuse therethrough at a controlled rate.

11. A chemical mixing and metering apparatus according to claim 9, wherein the reservoir portion includes at least one hole formed therethrough.

12. A chemical mixing and metering apparatus according to claim 1, wherein the removable chemical holder includes a cap portion and a solid chemical attached to the cap portion.

13. A chemical mixing and metering apparatus according to claim 1, wherein the chemical holder includes a chemical selected from the group consisting of fertilizers, herbicides and pesticides.

* * * * *